United States Patent [19]

Stern et al.

[11] Patent Number: 5,005,868

[45] Date of Patent: Apr. 9, 1991

[54] RETRACTABLE SLING FOR TRANSPORTING COASTER-TYPE VEHICLES

[76] Inventors: Bradley M. Stern, 3 Chester La., Nanuet, N.Y. 10977; James Doane, 213 E. 6th St., Clifton, N.J. 07011

[21] Appl. No.: 505,403

[22] Filed: Apr. 6, 1990

[51] Int. Cl.[5] ..... A63C 11/00

[52] U.S. Cl. ..... 280/814; 280/87.042

[58] Field of Search ..... 280/809, 814, 87.042, 280/87.041; 224/151, 273

[56] References Cited

U.S. PATENT DOCUMENTS 4,887,825 12/1989 Allen et al. ..... 280/809

*Primary Examiner*—Andres Kashnikow
*Assistant Examiner*—Richard Camby
*Attorney, Agent, or Firm*—Patrick J. Pinto

[57] ABSTRACT

A retractable sling assembly for mounting to coaster-type vehicles including an enclosure adapted for carrying a storage member within, said storage member arrayed for winding and holding a selected portion of a flexible sling thereon, said flexible sling having a free end to which an attaching member is secured; and a connecting member mounted to the vehicle for engaging the attaching member thereby holding the flexible sling in a more or less extended condition as and when desired.

14 Claims, 2 Drawing Sheets

RETRACTABLE SLING FOR TRANSPORTING COASTER-TYPE VEHICLES

BACKGROUND OF THE INVENTION

FIELD OF THE INVENTION

With respect to the art, as established in and by the United States Patent and Trademark Office, this invention is believed to be found in the general class entitled "Land Vehicles" and more particularly "Coasters".

SUMMARY OF THE INVENTION

Coaster-type vehicles such as skateboards and the like are intended to transport the user from one place to another. Of course there are many instances when the skateboard may not be used, but must be carried, transported, or stored by the user. The present apparatus is directed to those instances when a skateboard is not used to transport the user from one location to another. Therefore this invention may be summarized, at least in part, with reference to its objects.

It is an object of this invention to provide and it does provide a novel flexible sling assembly for transporting or storing a coaster-type vehicle.

It is a further object of this invention to provide and it does provide a novel flexible sling assembly for transporting or storing coaster-type vehicles. This sling may be mounted on any convenient surface of said vehicle.

It is still a further object of this invention to provide and it does provide a flexible sling assembly for transporting or storing coaster-type vehicles. This small and light-weight sling assembly will not hamper the operation of the vehicle on which it is attached.

It is still another object of this invention to provide and it does provide a flexible sling assembly for transporting or storing a coaster-type vehicle which is retractible.

In addition of the above summary, the following disclosure is detailed to insure adequacy and aid in the understanding of this invention. This disclosure, however, is not intended to cover each new and inventive concept, no matter how it may later be disguised either by variation in form or additions by further improvements. For this reason, there has been chosen specific embodiments of a flexible sling assembly for transporting coaster-type vehicles. This sling is adaptable for securing to the vehicle at selected locations without interfering with the operation of said vehicle. These specific embodiments have been chosen for the purpose of illustration and description, as shown in the accompanying drawings wherein:

BRIEF DESCRIPTION OF THE DRAWING

In the following description and in the claims, various details are identified by specific names for convenience. These names are intended to be generic in their application. The corresponding reference characters refer to like members throughout the several figures of drawings.

The drawings, accompanying and forming a part of this specification, disclose certain details of construction associated with a flexible sling assembly for mounting to a coaster-type vehicle. These details are for the purpose of explanation, but structural details may be modified without departure from the concept and principles of the present invention. It is anticipated that this invention may be incorporated in uses and forms other than shown and described.

EMBODIMENT OF FIGS. 1 AND 2

Figure 1:
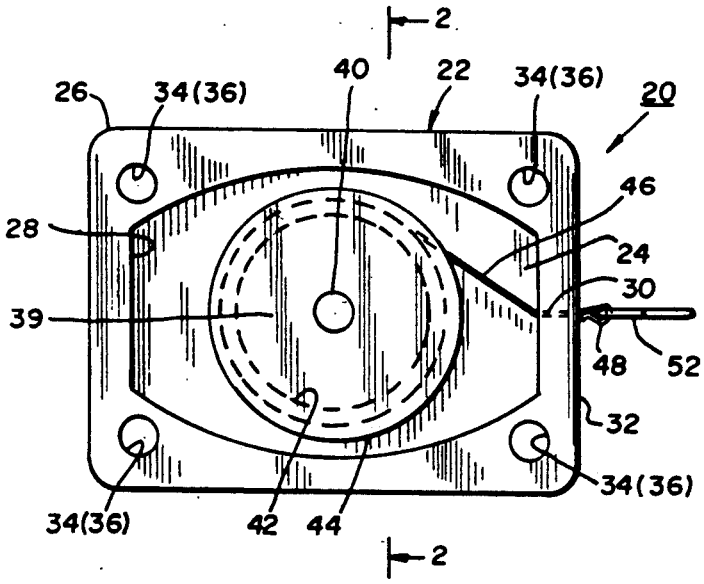
FIG. 1 represents a plan view of a reel assembly and its enclosure for housing a flexible sling for transporting coaster-type vehicles.

Referring to FIG. 1, a flexible sling assembly for mounting to a coaster-type vehicle is generally identified as 20. This flexible sling assembly 20 includes an enclosure portion 22 having a substantially flat bottom member 24 and a hollow intermediate portion 26. The hollow intermediate portion 26 has a recess portion 28 formed therein. A slot 30 is formed in one of the sides 32 of the hollow intermediate portion 26. A plurality of apertures 34 are selectively positioned in and through the intermediate portion 26.

A plurality of apertures 36 are formed in and through the flat bottom member 24. Apertures 36 are sized and positioned to be in alignment with apertures 34 for reasons which will become apparent later in this description.

Figure 2:
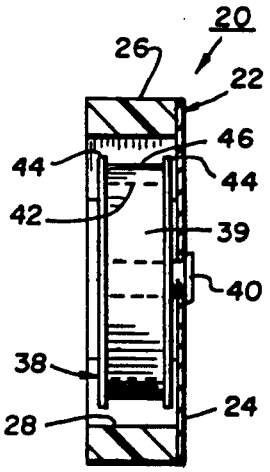
FIG. 2 represents a sectional view of the apparatus of FIG. 1., this view taken along line 2—2 of FIG. 1.

Referring to FIG. 2, a sling storage means such as a reel member 38 is mounted to the bottom member 24 by a suitable fastening means 40 such as a rivet, a threaded fastener, or the like. The reel member 38 preferably has a hub portion 42 and a pair of extending flanges 44. A flexible sling 46 is attached to and wound around the hub portion 42. The flexible sling 46 has been shown as a thin textile tape or ribbon. It has been found that a woven NYLON® ribbon provides satisfactory results as a flexible sling. For example, a flexible sling 46 having a width of 9.5 mm. (0.375 in.) and a thickness of 0.23 mm (0.009 in.) provides satisfactory results as to strength and flexibility. It is anticipated that other materials may be used such as a small diameter cord, cable, or rope. The length of the flexible sling 46 when fully extended is between 14 cm. (36 in.) and 19 cm. (48 in.). A preferred length of 16.5 cm. (42 in.) has been found to give satisfactory results. Referring again to FIG. 1, a free end 48 of the flexible sling 46 passes through the slot 30 of the intermediate portion 26. An attaching means 52 is provided at the free end 48 of the sling 46. This attaching means may be a S-hook, a swivel clasp, or the like. This attaching means 52 stops the free end 48 from entering into the enclosure 22. Other uses of this attaching means 52 will be discussed and become apparent below.

Still referring to FIG. 1. the reel member 38 is preferably of a self-retracting type which employs an internally mounted tensioning means such as a constant-force spring 39. The constant-force spring 39 may be selected from commercially available springs exerting a tensile force between 2 and 5 pounds. A constant-force spring applying a tensile force of about 3 pounds has been found to give excellent results.

The hollow intermediate portion 26 may be made from an extruded plastic material. This intermediate portion 26 may be made in one piece or a number of thin pieces stacked to give a desired thickness. A medium density Urethane material has been found to give excellent results. However it is contemplated that a suitable metal material may be used. It is further anticipated that the enclosure 22 may be formed using a one-piece construction.

EMBODIMENT OF FIGS. 3 AND 4

Figure 3:
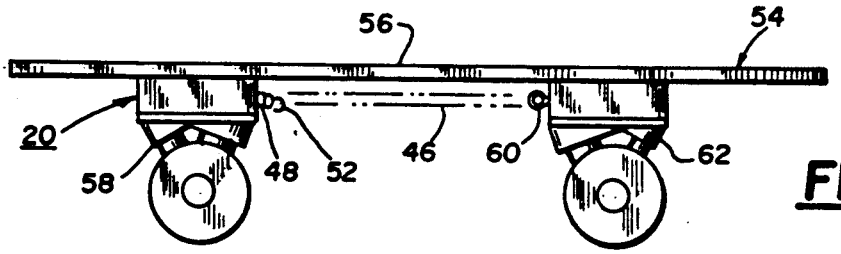
FIG. 3 represents a side elevation view of a typical coaster-type vehicle, partly diagrammatic and in a reduced scale, this view showing the mounting of the apparatus of FIG. 1 between the foot-board and the trucks.

Referring now to FIG. 3, a flexible sling assembly 20 is attached at a first end of a skateboard 54. This flexible sling assembly 20 is mounted between the foot-board 56 and a truck 58 and acts as a spacer. The apertures 34 and 36 are selectively positioned to align with the mounting holes 59 in the truck 58. A suitable fastening means such as screws, lockwashers, and nuts are used to attach the truck 58 and flexible sling assembly 20 to the foot-board 56. It should be noted that the flexible sling assembly may be provided without any mounting apertures to allow for custom drilling by an installer.

A connecting means 60 such as a loop, eye, or the like is mounted to and on the skateboard 54 at a second end distal the first end. This connecting means 60 may be secured to a leveling spacer 62 located between the foot-board 56 and the truck 62, which has been selectively located at the distal end. It is to be noted that the attachment of the flexible sling assembly 20 and the connecting means 60 may be interchangeably mounted to either end of the skateboard.

Figure 4:
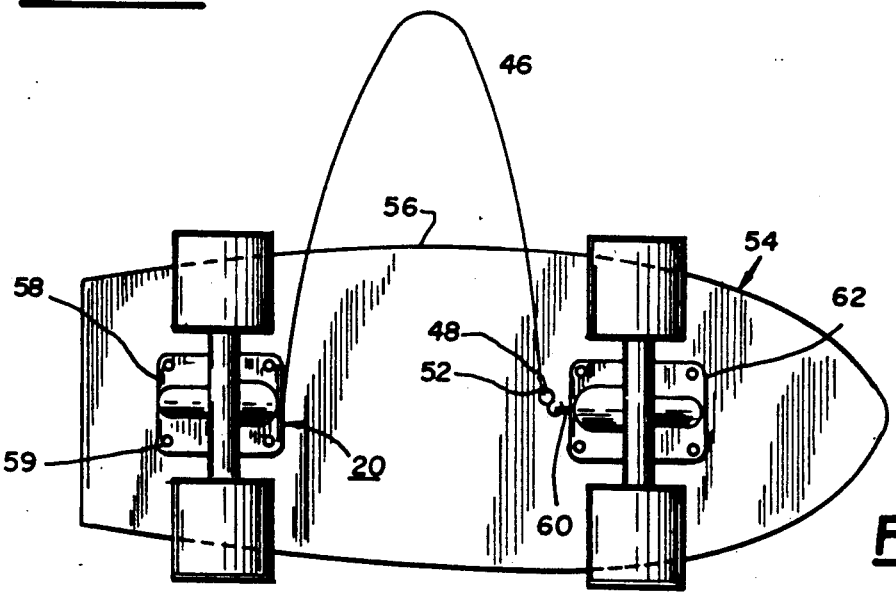
FIG. 4 represents a plan view of the vehicle of FIG. 3, this view, partly diagrammatic, shows the flexible sling in an extended and attached condition.

Referring to FIG. 4, when a user desires to transport, carry or store the skateboard 54, it is necessary to connect the attaching means 52 to the connecting means 60. The user would grasp the sling extending between the enclosure portion 22 and the connecting means 60. The flexible sling 46 will form a loop substantially as shown. The flexible sling 46 may be place on and over the shoulder of the user thereby allowing the use of both hands to carry other objects. This looped sling 46 also provides a convenient means hanging the skateboard 54 during storage.

The preferred embodiment utilizes a retracting means 39 for coiling a selected length of the flexible sling 46 onto the reel 38 within the enclosure 22 when not in an extended condition. This retracting means 39 has been previously described as a self-retracting type, but a manual retracting type may be used. The user may elect to leave the flexible sling 46 attached and extending between the enclosure 22 and the connecting means 60 while riding on the skateboard. The retracted position of the flexible sling 46 is preferred since it will keep unwanted dirt, dust and moisture from collecting on the sling during the riding of the skateboard 54.

EMBODIMENTS OF FIGS. 5; 6; AND 7

Figure 5:
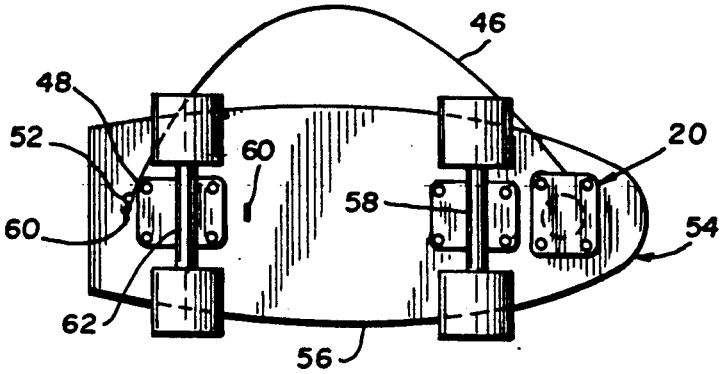
FIG. 5 represents a plan view of a coaster-type vehicle, this view partly diagrammatic and showing a first alternate mounting arrangement for the flexible sling.

FIGS. 5; 6; and 7 disclose alternate mounting arrangements for the flexible sling assembly 20 and the connecting means 60. Referring to FIG. 5, the flexible sling assembly 22 and the connecting means 60 are mounted directly to the foot-board 56 of the skateboard 54. This arrangement allows the trucks 58 and 62 to be mounted at a selected spacing from the foot-board 56. As previously described, when it is desired to transport, carry, or store the skateboard, the attaching means 52 of the flexible sling 46 is engaged in the connecting means 60. The user may then transport the skateboard by grasping the extended flexible sling 46 or placing the sling over his or her shoulder. When not in use the flexible sling 46 would be retracted manually or automatically into the enclosure 22. It is to be noted that this arrangement may be particularly employed with a short skateboard.

Figure 6:
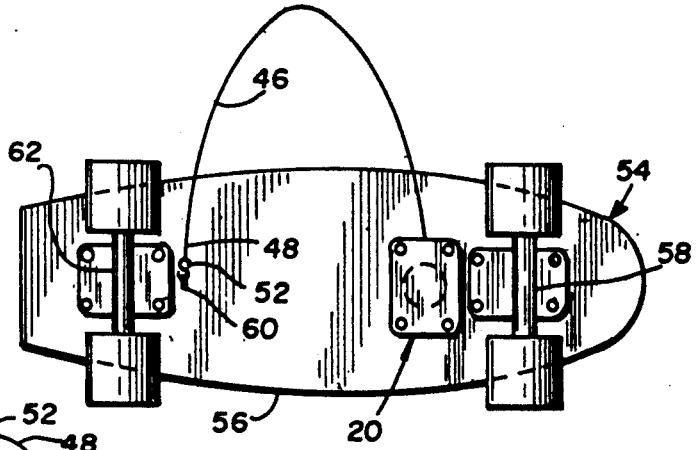
FIG. 6 represents a plan view of a coaster-type vehicle, this view, partly diagrammatic and showing a second alternate mounting arrangement for a flexible sling.

Referring to FIG. 6, the flexible sling assembly 20 and the connecting means are mounted between the trucks 58 and 62 and directly to the foot-board 56. As in FIG. 5 this arrangement allows for the mounting of the trucks 58 and 62 at a preferred height from the foot-board 56 by using selected spacers.

Figure 7:
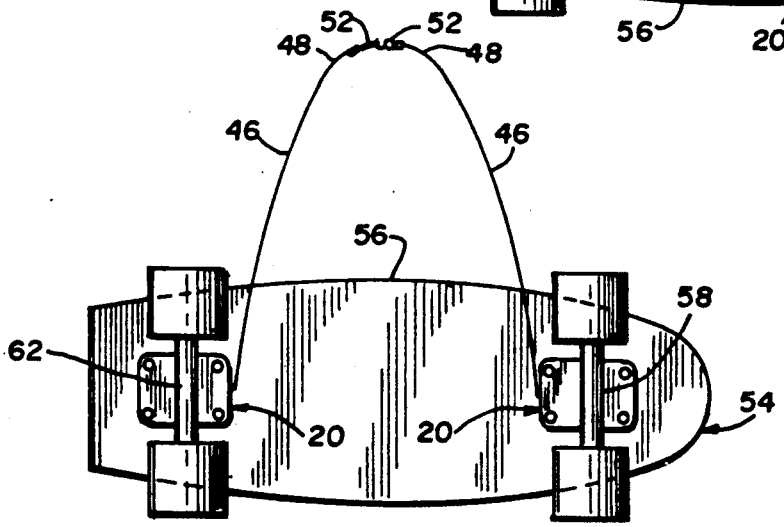
FIG. 7 represents a plan view of a coaster-type vehicle, this view partly diagrammatic and showing a third alternate arrangement of using two flexible sling assemblies.

Referring to FIG. 7, a skateboard is fitted with two flexible sling assemblies 20. Each of the assemblies 20 is shown mounted between the truck 58 or 62 and the foot-board 54. In use, each attaching end 52 of its associated sling 46 are connected to each other substantially as shown. This arrangement allows for a longer loop of a sling to be formed if and when desired. It is to be noted that the two flexible sling assemblies 20 may be mounted directly to the foot-board 56 at locations other than at the truck mounting locations.

Terms such as "left", "right", "up", "Down", "bottom", "top", "front", "back", "in", "out" and the like are applicable to the embodiments shown and described in conjunction with the drawings. These terms are merely for the purpose of description and do not necessarily apply to the position in which the retractable sling for transporting coasters of the present invention may be employed.

While these particular embodiments of a retractable sling for transporting coasters and the like have been shown and described, it is to be understood that the invention is not limited thereto and protection is sought to the broadest extent the prior art allows.

What is claimed is:

1. A sling assembly for carrying, transporting, or storing of a coaster-type vehicle, said sling assembly including:

(a) a flexible sling having a determined length, a free end, and a second end;

(b) an enclosure adapted for mounting to said vehicle as a spacer between a truck member and said vehicle, said enclosure further arrayed for the passage of the flexible sling therethrough;

(c) a storage means carried interior of said enclosure, said storage means adapted for holding and storing a selected portion of said flexible sling within said enclosure, said storage means being attached to said second end of said flexible sling;

(d) a connecting means adapted for attaching to said vehicle at a second selected position, said second selected position at or near a second end of said vehicle;

(e) an attaching means arrayed for securing to said free end of said flexible sling exterior of said enclosure, said attaching means further arrayed for engaging said connecting means and holding said flexible sling in an extended condition, said extended condition allowing for said carrying, transporting, or storing; and (f) a means for retracting said selected portion of said flexible sling into said enclosure and onto said storage means as and when desired.

2. A sling assembly as recited in claim 1 wherein said storage means is a rotatable reel member, said reel member adapted for winding said flexible sling thereon.

3. A sling assembly as recited in claim 2 wherein said reel member further includes:

(a) a central hub portion for the storing and holding of said flexible sling thereon; and (b) a plurality of flange members extending from said hub portion, said flange members selectively arrayed for guiding said flexible sling onto said hub portion.

4. A sling assembly as recited in claim 1 wherein said flexible sling is a thin textile tape or ribbon.

5. A sling assembly as recited in claim 1 wherein said connection means is an eye or a loop.

6. A sling assembly as recited in claim 1 wherein said attachment means is a S-shaped hook.

7. A sling assembly as recited in claim 1 wherein said attaching means is a swivel clasp.

8. A sling assembly as recited in claim 1 wherein said means for retracting is a constant-force spring, said constant-force spring being mounted integrally within said storage means.

9. A sling assembly as recited in claim 8 wherein said constant-force spring exerts a tensile force of between 2 and 5 pounds.

10. A sling assembly for carrying, transporting, or storing of a coaster-type land vehicle including:

(a) a enclosure arrayed for mounting to said vehicle between a truck member of said vehicle and a footboard of said vehicle, said enclosure further arrayed for the passage of a flexible sling therethrough;

(b) said flexible sling having a determined length, a free end, and a second end;

(c) a storage means carried interior of said enclosure, said storage means arrayed for holding and storing a selected portion of said flexible sling within said enclosure, said storage means including:

(1c) a reel member having a central hub, a plurality of flange members, and a means for attaching to said second end of the flexible sling, said central hub portion arrayed for winding and storing said flexible sling thereon, said plurality of flanges selectively arrayed for guiding said flexible sling onto said central hub portion;

(d) a connecting means adapted for attaching to said vehicle at a second selected position, said second selected position at or near a second end of said vehicle;

(e) an attaching means adapted for securing to said free end of said flexible sling exterior of said enclosure, said attaching means further arrayed for engaging said connection means and holding said flexible sling in an extended condition, said extended condition allowing for said carrying, transporting, or storing; and (f) and a means for retracting said selected portion of said flexible sling into said enclosure and onto said storage means as and when desired.

11. A sling assembly as recited in claim 10 wherein said means for retracting is a constant-force spring, said contant-force spring being mounted integrally within said reel member.

12. A sling assembly as recited in claim 11 wherein said flexible sling is a thin textile tape or ribbon.

13. A sling assembly as recited in claim 12 wherein said attachment means is a S-shaped hook.

14. A sling assembly as recited in claim 12 wherein said attaching means is a swivel clasp.

* * * * *